US008909108B2

(12) United States Patent
Furukawa

(10) Patent No.: US 8,909,108 B2
(45) Date of Patent: Dec. 9, 2014

(54) DEVELOPING DEVICE

(71) Applicant: Canon Kabushiki Kaisha, Tokyo (JP)

(72) Inventor: Mitsuhiro Furukawa, Kawaguchi (JP)

(73) Assignee: Canon Kabushiki Kaisha, Toyko (JP)

( * ) Notice: Subject to any disclaimer, the term of this patent is extended or adjusted under 35 U.S.C. 154(b) by 0 days.

(21) Appl. No.: 14/087,398

(22) Filed: Nov. 22, 2013

(65) Prior Publication Data

US 2014/0147176 A1 May 29, 2014

(30) Foreign Application Priority Data

Nov. 28, 2012 (JP) ..... 2012-260073

(51) Int. Cl.
*G03G 15/09* (2006.01)
*G03G 15/08* (2006.01)

(52) U.S. Cl.
CPC .... *G03G 15/0818* (2013.01); *G03G 2215/0648* (2013.01)
USPC ..... 399/269

(58) Field of Classification Search
CPC ..... G03G 15/0808; G03G 15/0894; G03G 15/08; G03G 15/0928; G03G 21/1676; G03G 2215/06; G03G 2215/0634; G03G 2215/0648
See application file for complete search history.

(56) References Cited

U.S. PATENT DOCUMENTS

| | | | | |
|---|---|---|---|---|
| 6,269,235 | B1 * | 7/2001 | Nishiyama | 399/267 |
| 2008/0279598 | A1 * | 11/2008 | Van Dessel | 399/286 |
| 2011/0129262 | A1 * | 6/2011 | Nakamoto | 399/286 |
| 2014/0023408 | A1 * | 1/2014 | Kato et al. | 399/269 |

FOREIGN PATENT DOCUMENTS

| | | | |
|---|---|---|---|
| JP | 6061776 | A | 4/1985 |
| JP | 2000321864 | A | 11/2000 |
| JP | 2003323052 | A | 11/2003 |
| JP | 2007072221 | A | 3/2007 |
| JP | 2011170100 | A | 9/2011 |

* cited by examiner

*Primary Examiner* — Clayton E LaBalle
*Assistant Examiner* — Victor Verbitsky
(74) *Attorney, Agent, or Firm* — Canon U.S.A., Inc. IP Division

(57) ABSTRACT

An inclined angle that an upstream surface of each groove in an upstream developing sleeve forms with the surface of the upstream developing sleeve is set smaller than an inclined angle that an upstream surface of each groove in a downstream developing sleeve forms with the surface of the downstream developing sleeve. This configuration increases a difference in transfer power between the upstream and downstream developing sleeves, thereby enabling the upstream developing sleeve to transfer a developer to the downstream developing sleeve efficiently.

7 Claims, 12 Drawing Sheets

DEVELOPING DEVICE

BACKGROUND OF THE INVENTION

1. Field of the Invention

The present invention relates to a developing device used to form an image by employing an electrophotographic method or an electrostatic recording method. More specifically, the present invention relates to a developing device that transfers a developer between a plurality of developer bearing members.

2. Description of the Related Art

To date, many developing devices equipped with a developing sleeve have been proposed and employed, as developing devices for utilizing an electrophotographic method or electrostatic recording method to develop an electrostatic latent image formed on an image bearing member with a single-component developer or a two-component developer.

Typically, the developing sleeve is rotatably supported by an opening of the developing device through bearings arranged at both ends of the developing sleeve. The developing sleeve is subjected to a surface roughening processing through, for example, blasting. This developing sleeve bears and conveys a developer, and visualizes a latent image on an image bearing member with the borne developer.

If the quantity of the developer on the surface of the developing sleeve is not uniform, the density of the visualized image on a photosensitive member may also become non-uniform, in which case a problem with an image quality arises. To avoid this problem, it is desirable to equalize the quantity of the developer on the surface of the developing sleeve. In general, use of a regulating member called a regulating blade permits the quantity of the developer on the surface of a developing sleeve to be uniform.

A typical developing device is equipped with a development container that stores a developer, and conveyance members, such as a screw, disposed in the development container. These conveyance members circulate and convey the developer within the development container.

On the other hand, recently, the operating speed of such an image forming apparatus using the electrophotographic method has been increased. Japanese Patent Application Laid-Open Nos. 2003-323052, 2007-72221, and 60-061776 discuss developing devices that are operable at a high speed. These developing devices are each equipped with a plurality of developing sleeves using two-component magnetic brushes, to increase development opportunities. The developing device in Japanese Patent Application Laid-Open No. 2003-323052 includes an upstream developing sleeve provided with a blade, and a downstream developing sleeve positioned below the upstream developing sleeve, as illustrated in FIG. 1, and both of the sleeves transfer and convey a developer while rotating in the same direction. Thus, this developing device yields the compactness despite employing the twin sleeves.

As for twin developing sleeves using, as described above, a two-component developer, Japanese Patent Application Laid-Open No. 2007-72221 discusses a technique for suppressing a developer from staying between upstream and downstream developing sleeves by specifying the magnetic force between the respective transfer poles in the upstream and downstream developing sleeves, as illustrated in FIGS. 11A, 11B, and 11C.

Unfortunately, the recent increase in the operating speed of developing devices has caused the following problems. The surfaces of the sleeves which have undergone the blasting processing are likely to be worn out along with the continuous use. In such a case, the developer may slip over the surfaces of the sleeves rotating at a high speed, thereby causing the degradation of the transfer efficiency. In addition, the developer that stays between the sleeves may accelerate the chipping of the sleeves. To secure the conveyance capacity for continuous use, a groove sleeve is employed, in which a plurality of grooves for conveying a developer is provided on the outer surface of each developing sleeve. In Japanese Patent Application Laid-Open No. 60-061776 that is a patent document about the groove sleeve in the twin developing method, all the grooves in the downstream developing sleeve have a larger total volume than those in the upstream developing sleeve, as illustrated in FIGS. 12A and 12B. This structure relatively increases the conveying capacity of the downstream developing sleeve, thereby suppressing the developer from staying between the sleeves.

Even by setting the total volume of all the grooves in the downstream developing sleeve larger than that in the upstream developing sleeve as in the conventional way, however, the transfer efficiency of each groove cannot be increased effectively. In fact, there arises a risk that, when the upstream developing sleeve transfers the developer to the downstream developing sleeve, the developer staying between the sleeves is degraded by being rubbed therebetween. For example, when the downstream developing sleeve having an increased number of grooves is used to increase the transfer efficiency, a large number of grooves may pass through the developer staying between the upstream and downstream developing sleeves, in which case the developer could be degraded. The degraded toner accumulated in the grooves of the sleeves may be contaminated, thereby degrading the conveyance capacity. To reserve the conveyance capacity even if the toner contaminated to some extent is present in the grooves, a configuration employing deep grooves is conceivable. However, if excessively deep grooves are used, a co-rotation phenomenon may occur, that is, the developer which has not been chipped by the repulsive poles in the downstream developing sleeve may be discharged from the gap between the upstream and downstream developing sleeves. The occurrence of the co-rotation phenomenon may result in the degradation of the transfer efficiency.

SUMMARY OF THE INVENTION

The present invention is directed to a developing device that transfers a developer between a plurality of developer bearing members whose surfaces are subjected to groove processing, and that can improve efficiency of transferring the developer between the developer bearing members while suppressing the degradation of the developer.

According to an aspect of the present invention, a developing device includes a first developer bearing member having a surface provided with a plurality of grooves, the first developer bearing member being configured to bear a developer containing at least magnetic particles on the surface with a magnetic force, and to convey the developer to a first developing region opposite an image bearing member, and a second developer bearing member having a surface provided with a plurality of grooves, the second developer bearing member being configured to rotate in the same rotational direction as the first developer bearing member, to receive the developer from the first developer bearing member at a site opposite the first developer bearing member, and to bear the received developer on the surface with a magnetic force to convey the received developer to a second developing region opposite the image bearing member, wherein an angle that a surface, which is located upstream in the rotational direction, of each groove in the first developer bearing member forms with a normal to the first developer bearing member is larger than an angle θ2 that a surface, which is located upstream in the rotational direction, of each groove in the second developer bearing member forms with a normal to the second developer bearing member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. Although the developing device is used in, for example, an image forming apparatus to be described below, the usage of this developing device is not necessarily limited to this example. The developing device is accordingly applicable to any given image forming apparatus, including a tandem type image forming apparatus with a plurality of image bearing members, and an image forming apparatus with a single image bearing member. Also, the developing device can be arbitrarily implemented using either an image forming apparatus with an intermediate transfer member, which temporarily transfers an image from an image bearing member to the intermediate transfer member and then transfers this image to a recording material, or an image forming apparatus that directly transfers an image from the image bearing member to a recording material. Moreover, the developing device can be arbitrarily implemented using a configuration for transferring a developer between a plurality of developer bearing members, regardless of whether a two-component developer or a single-component developer is used. In the exemplary embodiments, a principal part for forming a toner image will be described, but embodiments of the present invention can be implemented with required apparatus, equipment, and casing structure in various applications including printers, various printing machines, copying machines, facsimile (FAX) machines, and multifunction peripherals.

Figure 1:
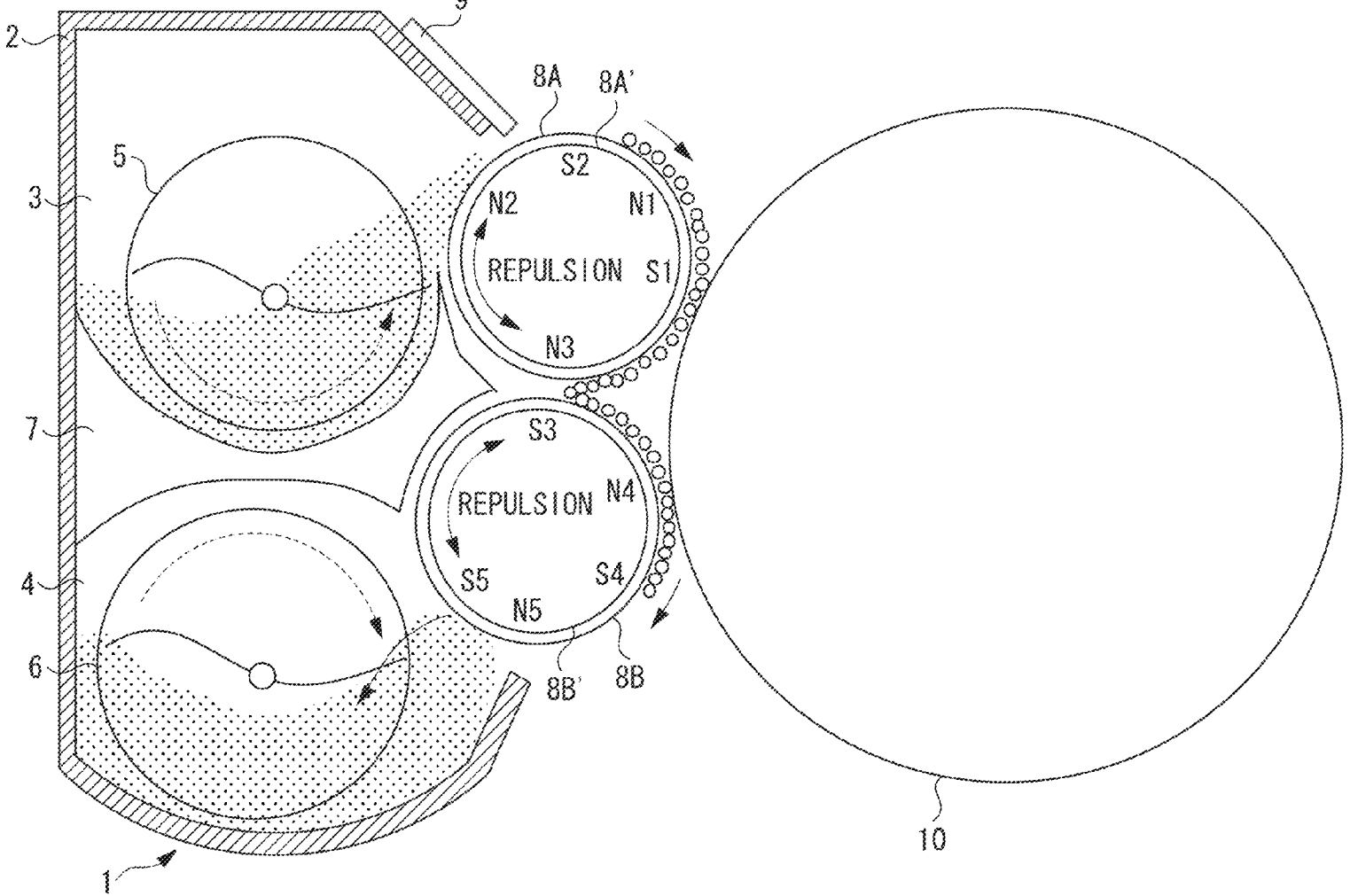
FIG. 1 is a view illustrating a sectional configuration of a developing device that can implement an exemplary embodiment of the present invention.

FIG. 1 is a view illustrating a positional relationship between a developing device 1 and an image bearing member (photosensitive drum) 10 at a station for each of Y, M, C, and K in a full-color image forming apparatus. Each of the stations for Y, M, C, and K has substantially the same configuration, and forms images of yellow (Y), magenta (M), cyan (C), and black (K), respectively, in a full-color image. In the following description, the developing device 1 designates in common a developing device 1Y, a developing device 1M, a developing device 10, and a developing device 1K in each of the stations for Y, M, C, and K, respectively.

Figure 2:
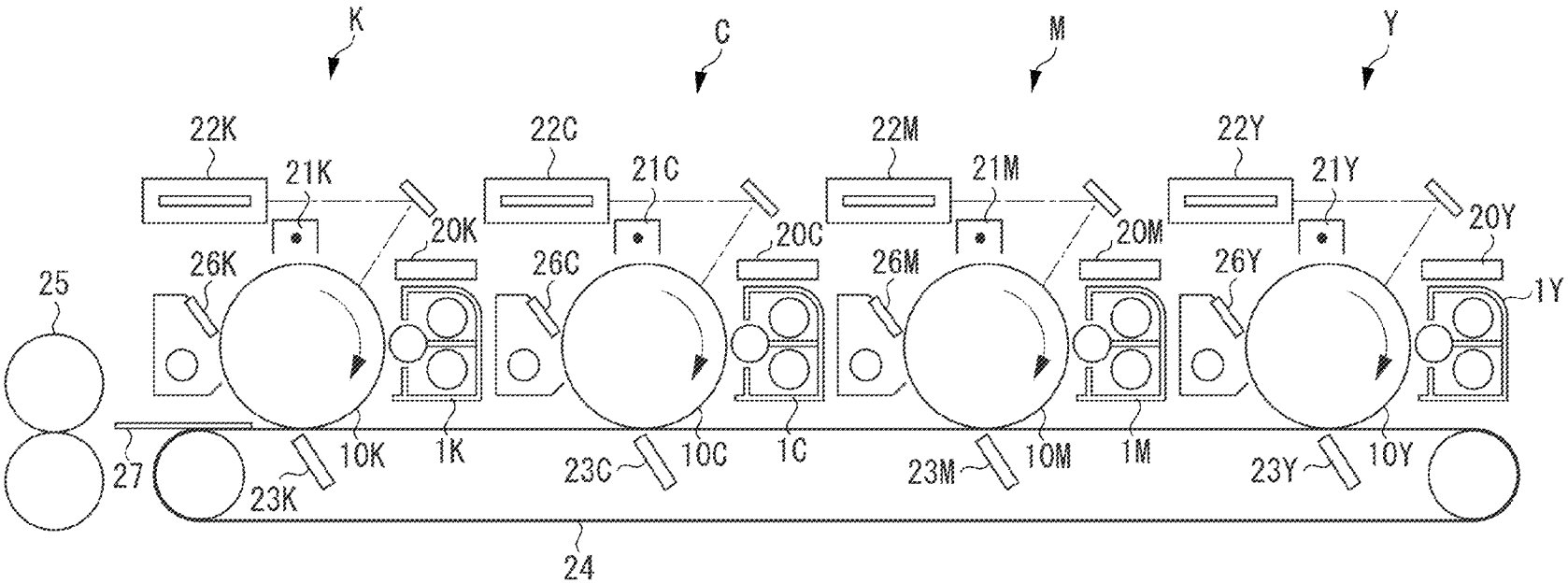
FIG. 2 is a schematic view illustrating a configuration of an image forming apparatus according to an exemplary embodiment of the present invention.

First, an overall operation of the image forming apparatus will be described with reference to FIG. 2. The photosensitive drum 10, which serves as an image bearing member, is rotatably provided. A primary charging unit 21 uniformly charges the photosensitive drum 10, and a light emitting element 22 such as a laser diode exposes the photosensitive drum 10 to light modulated according to an information signal, thereby creating a latent image. The developing device 1 visualizes the latent image as a developed image (toner image) through a process to be described below. A first transfer charging unit 23 transfers, for each station, the toner image to a transfer sheet 27 that is a recording material conveyed by a transfer material conveyance sheet 24. Then, a fixing device 25 fixes the transferred image, thereby providing a permanent image. A cleaning device 26 removes the residual transfer toner from the photosensitive drum 10. The toner contained in the developer which is to be consumed to form an image is supplied from a toner replenishing tank 20. Here, the configuration is used in which an image is directly transferred to the transfer sheet 27 that is the recording material conveyed from photosensitive drums 10M, 10C, 10Y, and 10K by the transfer material conveyance sheet 24; however the exemplary embodiments of the present invention are not limited to this configuration. The exemplary embodiments of the present invention may also employ a configuration for: providing an intermediate transfer member instead of the transfer material conveyance sheet 24; primarily transferring toner images of corresponding colors from the photosensitive drums 10M, 10C, 10Y, and 10K to the intermediate transfer member; and then secondarily transferring the combined toner image of the respective colors from the intermediate transfer member to a transfer sheet at one time. Here, the process speed of the image forming apparatus is 500 mm/s.

[Two-Component Developer]

Next, a description will be given of a two-component developer containing a nonmagnetic toner and a magnetic carrier, which is used in the exemplary embodiments.

The toner contains a binding resin, a colorant, coloring resin particles containing other additives if needed, and coloring particles to which an additive such as colloidal silica fine powder is externally added. The toner is a negatively charged polyester resin, and the volume average particle diameter of the toner is 7.0 μm in the exemplary embodiments.

A surface-oxidized or -unoxidized metal such as iron, nickel, cobalt, manganese, chromium, a rare-earth metal, an alloy thereof, or an oxide ferrite may be suitably used as the carrier, and there is no specific limitation on the manufacturing process for these magnetic particles.

[Developing Device]

Next, an operation of the developing device 1 will be described with reference to FIG. 1. The developing device 1 of the first exemplary embodiment includes an upstream developing sleeve 8A and a downstream developing sleeve 8B, which serve as first and second developer bearing members, respectively. The upstream developing sleeve 8A receives a developer from a developing chamber 3, and transfers the developer to an opposite site between the upstream developing sleeve 8A and the downstream developing sleeve 8B. Here, the "upstream" and "downstream" are defined with respect to developer's flow between the sleeves.

A roller-shaped first mag (magnetic) roller 8A' is fixed to and disposed within the upstream developing sleeve 8A made of a nonmagnetic material. The upstream developing sleeve 8A is 20 mm in diameter, and bears and conveys a developer by rotating in a direction indicated by an arrow at a peripheral velocity of 750 mm/s. A regulating blade 9 is disposed above the upstream developing sleeve 8A, and a magnetic pole N2 is disposed at a site of the first mag roller 8A' which is close to the regulating blade 9. The regulating blade regulates a developer restrained and staying by virtue of the magnetic force of the magnetic pole N2 to have a proper thickness. Then, the upstream developing sleeve 8A bears and conveys the developer to a first developing region. The first mag roller 8A' has a developing magnetic pole S1 that opposes the first developing region. The developing magnetic pole S1 creates a magnetic brush of the developer due to a developing magnetic field generated in the first developing region. Then, this magnetic brush makes contact with the rotating photosensitive drum 10, acting as an image bearing member, in the first developing region, thereby developing an electrostatic latent image. In this case, the toners adhered to both the magnetic brush and the surface of the first developing sleeve 8A are also transferred to the imaging region of the electrostatic latent image, developing the electrostatic latent image. In the exemplary embodiments, the first mag roller 8A' has magnetic poles N1, N3, and S2 in addition to the magnetic poles S1 and N2. Of these magnetic poles, the magnetic poles N2 and N3 have the same pole and are arranged adjacent to each other. The magnetic poles N2 and N3 accordingly generate a repulsive magnetic field, thus creating a barrier to the developer.

The downstream developing sleeve 8B is provided below the upstream developing sleeve 8A described above, and is disposed in a region substantially opposite both the upstream developing sleeve 8A and the photosensitive drum 10. The downstream developing sleeve 8B is 20 mm in diameter, and is rotatable in a direction indicated by an arrow (in the same direction as the upstream developing sleeve 8A) at a peripheral velocity of 750 mm/s. The downstream developing sleeve 8B is made of a nonmagnetic material, similar to the upstream developing sleeve 8A, and houses a roller-shaped second mag roller 8B', which serves as a magnetic field generating unit, in an irrational fashion. The second mag roller 8B' has five magnetic poles, i.e., magnetic poles S3, N4, S4, N5, and S5. Of these magnetic poles, the magnetic pole N4 creates a magnetic brush that makes contact with the photosensitive drum 10 in a second developing region, and applies a second development to the photosensitive member that has passed through the first developing region. Since the magnetic poles S3 and S5 have the same pole, the magnetic poles S3 and S5 generate a repulsive magnetic field therebetween, thereby creating a barrier to the developer. The magnetic pole S3 opposes the magnetic pole N3 in the first mag roller 8A' housed in the upstream developing sleeve 8A at a location near respective closest sites of the upstream developing sleeve 8A and the downstream developing sleeve 8B.

The magnetic poles N3 and N2 in the first developing sleeve 8A generate a repulsive magnetic field therebetween, and the magnetic poles S3 and S5 in the second developing sleeve 8B also generate a repulsive magnetic field therebetween. In this case, when the developer that has been conveyed to the first developing sleeve 8A and has passed through the first developing region reaches the magnetic pole N3, the developer cannot pass through the respective closest sites of the upstream developing sleeve 8A and the downstream developing sleeve 8B due to the repulsive magnetic fields. As illustrated in FIG. 1, therefore, the developer moves to the downstream developing sleeve 8B along the line of the magnetic force which extends from the magnetic pole N3 to the magnetic pole S3, and then is conveyed along the downstream developing sleeve 8B to a second conveyance screw 6 in an agitation chamber 4. By providing the downstream developing sleeve 8B below the upstream developing sleeve 8A as in the exemplary embodiments, the developer flows in the following manner. The developer is conveyed to the magnetic poles N2, S2, N1, S1, and N3 on the upstream developing sleeve 8A in this order. Then, the developer on the upstream developing sleeve 8A is blocked by the repulsive magnetic fields generated in both of the sleeves, and moves to the downstream developing sleeve 8B. In turn, the developer is conveyed to the magnetic poles S3, N4, S4, N5, and S5 on the downstream developing sleeve 8B in this order. Then, the developer on the magnetic pole S5 is blocked by the repulsive magnetic field. As a result, the developer is chipped off the downstream developing sleeve 8B, moving to the agitation chamber 4.

The magnetic poles N3 and S3, each of which serves as a transfer pole, need not oppose each other completely. As long as the magnetic poles N3 and S3 substantially oppose each other within a range of 45° with respect to an arrangement in which the magnetic poles N3 and S3 oppose completely, the magnetic poles N3 and S3 can transfer the developer smoothly.

A partition wall 7 is provided at substantially the center of the development container 2 while extending in a front-back direction of FIG. 1. The partition wall 7 vertically separates the development container 2 into the developing chamber 3 and the agitation chamber 4, and each of the developing chamber 3 and the agitation chamber 4 stores a developer.

A first conveyance screw 5 and the second conveyance screw 6 are disposed in the developing chamber 3 and the agitation chamber 4, respectively. Each of the first conveyance screw 5 and the second conveyance screw 6 serves as a circulation unit to circulate a developer within the development container 2 by agitating and conveying the developer. The first conveyance screw 5 is disposed at the bottom of the developing chamber 3 and in substantially parallel with the shaft of the upstream developing sleeve 8A, and rotates to convey a developer within the developing chamber 3 in one direction along the shaft. The second conveyance screw 6 is disposed at the bottom of the agitation chamber 4 and in substantially parallel with the first conveyance screw 5, and conveys a developer within the agitation chamber 4 in the direction opposite to that in which the first conveyance screw 5 conveys the developer. Both the first conveyance screw 5 and the second conveyance screw 6 rotate to convey a developer in this manner, and the conveyed developer circulates between the developing chamber 3 and the agitation chamber 4 through openings (communicating portions) at both ends of the partition wall 7. A first conveyance screw unit supplies a developer from the regulating blade 9 and the openings of the partition wall 7 by driving the first conveyance screw 5. Each of the first conveyance screw 5 and the second conveyance screw 6 is configured by providing agitating wings made of a nonmagnetic material around a rotational shaft in a spiral fashion. The diameter of each screw, the spacing between the screws, and rotational frequency of the screws are set to 30 mm, 30 mm, and 800 rpm, respectively.

The toner and carrier in a developer pass through a region defined between the end of the regulating blade 9 and the upstream developing sleeves 8A, being sent to the first developing region. By adjusting a gap between the regulating blade 9 and the surface of the upstream developing sleeve 8A, the ear-cutting amount of the developer magnetic brush borne on the upstream developing sleeve 8A is regulated. As a result, the amount of developers conveyed to the first developing region can be adjusted. In the exemplary embodiments, the regulating blade 9 regulates the coating amount of the developer per unit area on the upstream developing sleeve 8A to 30 $mg/cm^2$. The coating amount of the developer on the downstream developing sleeve 8B becomes approximately 30 $mg/cm^2$, because the downstream developing sleeve 8B receives the developer from the upstream developing sleeve 8A. It is desirable that the coating amount of the developer on each of the upstream and downstream developing sleeves be kept at approximately 30±5 $mg/cm^2$ through continuous use.

[Developer Bearing Member]

Figure 3:
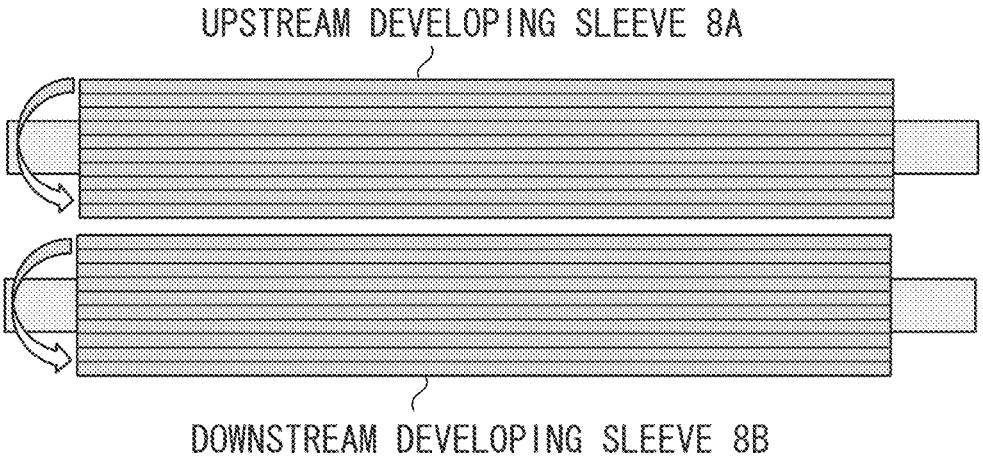
FIG. 3 is a view illustrating a configuration of the developing device according to an exemplary embodiment of the present invention as viewed from the front.
Figure 4A:
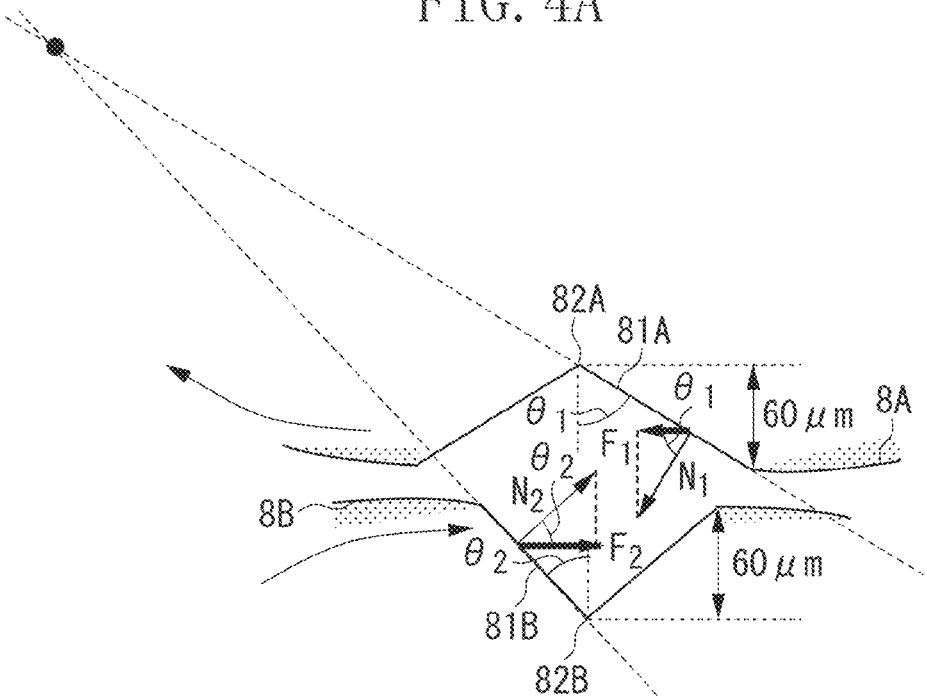
FIG. 4A is a schematic view illustrating a configuration of upstream and downstream developing sleeves, which can implement a first exemplary embodiment of the present invention.
Figure 4B:
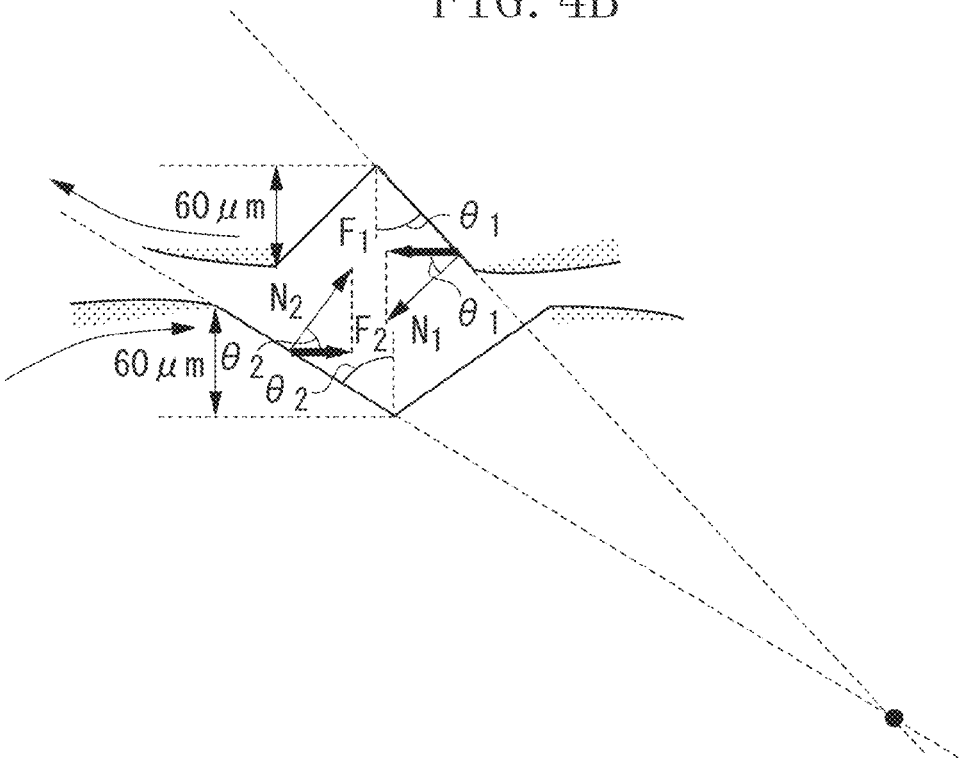
FIG. 4B is a schematic view illustrating a configuration of upstream and downstream developing sleeves in a comparative example.

A description will be given of the grooves of each sleeve used in the exemplary embodiments with reference to FIGS. 3, 4A, and 4B. FIG. 3 is a view illustrating the upstream developing sleeve 8A and the downstream developing sleeves 8B as viewed from the photosensitive drum 10 side. FIG. 4A is a view illustrating the cross-section of the upstream developing sleeve 8A which is orthogonal to the shaft of the upstream developing sleeve 8A, and FIG. 4B is a view illustrating the cross-section of the downstream developing sleeve 8B which is orthogonal to the shaft of the downstream developing sleeve 8B. FIGS. 4A and 4B are views of the respective closest sites of the upstream developing sleeve 8A and the downstream developing sleeve 8B.

In this exemplary embodiment, the surface of each of the upstream developing sleeve 8A and the downstream developing sleeve 8B has a plurality of grooves formed thereon. Sixty grooves are continuously formed in the upstream developing sleeve 8A at equal distances, and each of the grooves has a V-shape with a depth of 60 μm and a groove angle of 120°. Likewise, sixty grooves are continuously formed in the downstream developing sleeve 8B at equal distances, and each of the grooves has a V-shape with a depth of 60 μm and a groove angle of 90°. In this exemplary embodiment, the respective grooves in the upstream developing sleeve 8A and the downstream developing sleeve 8B establish a dimensional relationship as illustrated in FIG. 4A in a transfer portion therebetween. More specifically, in the transfer portion between the sleeves, a surface (side) 81B, which is located upstream in the rotational direction, of each groove in the downstream developing sleeve 8B forms a smaller angle with a normal to the sleeve (or a line extending from the center of the sleeve) than a surface (side) 81A, which is located upstream in the rotational direction, of each groove in the upstream developing sleeve 8A ($\theta_1>\theta_2$). Here, $\theta_1$ denotes an angle which a side, which is located upstream in the rotational direction, of each groove in the upstream developing sleeve 8A forms with the normal to the upstream developing sleeve 8A, and $\theta_2$ denotes an angle which a side, which is located upstream in the rotational direction, of each groove in the downstream developing sleeve 8B forms with the normal to the downstream developing sleeve 8B. In other words, the surface (side) 81B, which is located upstream in the rotational direction, of each groove in the downstream developing sleeve 8B is steeper than the surface (side) 81A, which is located upstream in the rotational direction, of each groove in the upstream developing sleeve 8A.

More specifically, when bottoms (peaks) 82A and 82B of the respective V-shaped grooves in both sleeves are located closest to each other, as illustrated in FIGS. 4A and 4B, both grooves have the following relationships. The extension of the upstream side of each groove in the upstream developing sleeve 8A and the extension of the upstream side of each groove in the downstream developing sleeve 8B intersect each other on the upstream developing sleeve 8A side. These V-shaped grooves are formed by manufacturing a die (dice) which enables grooves to be formed in an intended shape (depth, quantity, and angle), and by subjecting an aluminum tube to drawing with the die.

The idle rotation acceleration test was conducted on grooves formed in the above manner, and the transfer capacity and sleeve contamination of the grooves were evaluated. The condition of the idle rotation acceleration test was that the idle rotation of the developing device was performed in a thermostatic chamber at 40° C. for 10 hours with a developer injected. The coating amount of the developer on the upstream developing sleeve 8A was initially adjusted to 30 $mg/cm^2$, and the idle rotation was started. Then, the variation in the coating amount of a developer on the downstream developing sleeve 8B was measured. A similar examination was made in Comparative Examples 1, 2, and 3 as comparative examples.

Figure 5:
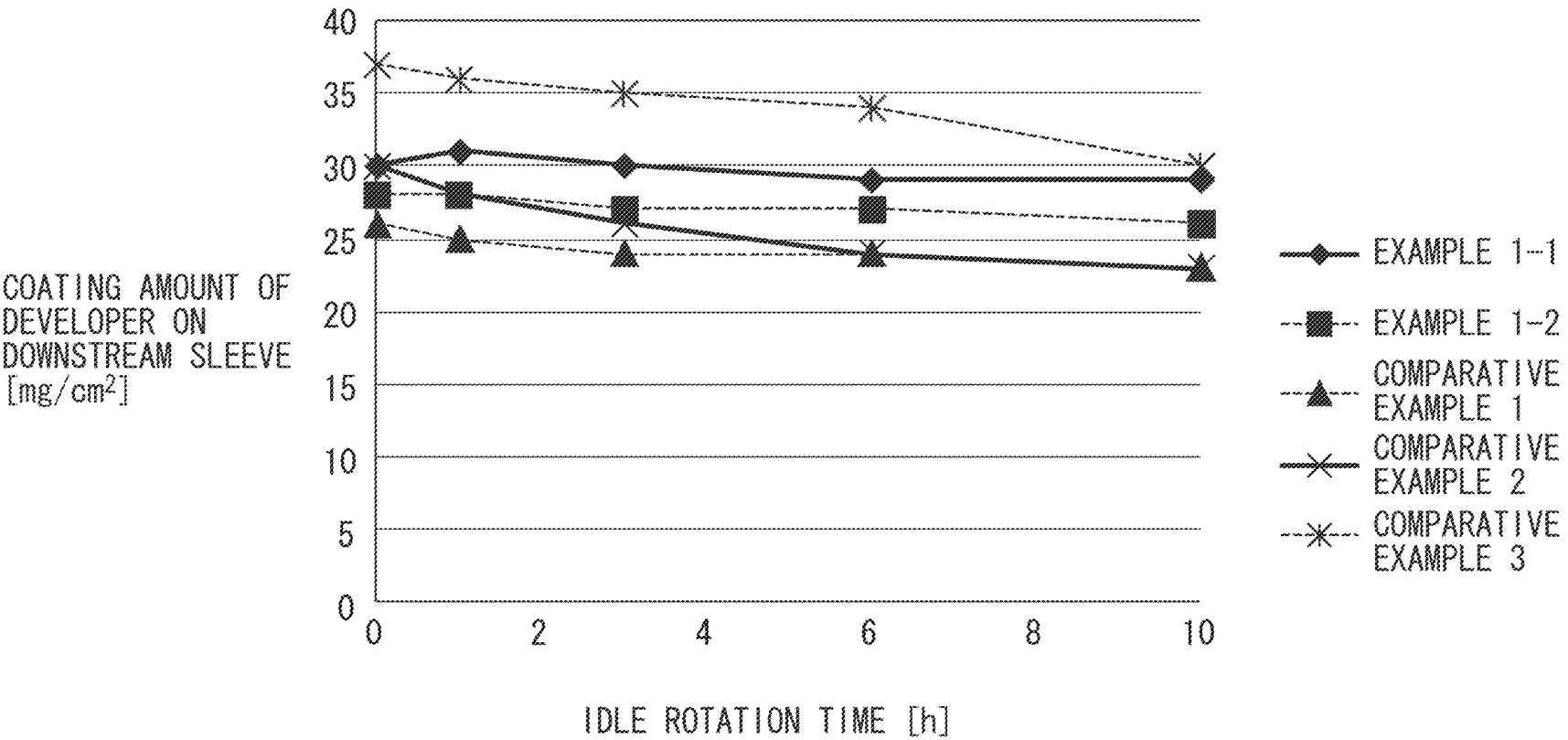
FIG. 5 is a graph illustrating a result of an idle rotation acceleration test conducted in the first exemplary embodiment of the present invention.
Figure 6A:
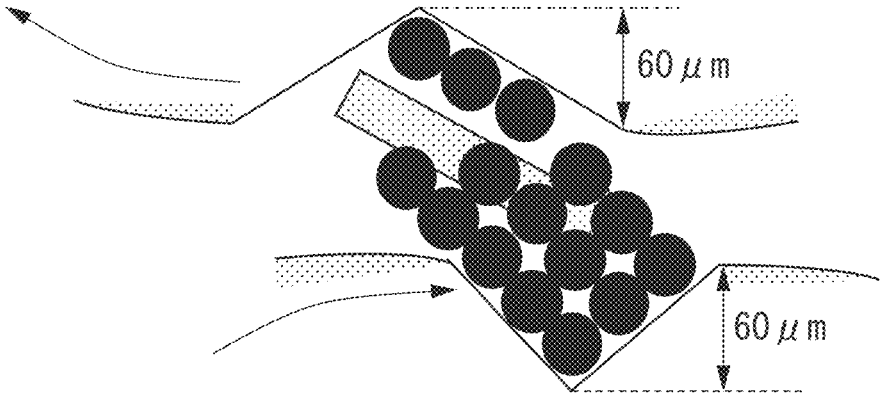
FIG. 6A is a schematic view illustrating transfer of the developer in the first exemplary embodiment of the present invention.

FIG. 5 is a graph of the test result. As for Example 1-1, the coating amount of the developer on the downstream developing sleeve 8B did not vary greatly from the early stage. Thus, Example 1-1 yielded the excellent result. A reason for this result is as follows. The upstream developing sleeve 8A magnetically transfers the developer to the downstream developing sleeve 8B, as illustrated in FIG. 6A. In addition, the ears of the developer retained in the grooves of the downstream developing sleeve 8B chip the developer which stays in the grooves of the upstream developing sleeve 8A. In this case, the ears chip the developer by virtue of a torque generated by a horizontal component of a vertical reaction received from the upstream sides of the grooves. As illustrated in FIG. 4A, assume that an angle which a normal to the upstream developing sleeve 8A which passes through the peak 82A of a groove forms with an upstream side of the groove is denoted by $\theta_1$, and an angle which a normal to the downstream developing sleeve 8B which passes through the peak 82B of a groove forms with an upstream side of the groove is denoted by $\theta_2$. Horizontal components $F_1$ and $F_2$ of vertical reactions $N_1$ and $N_2$ ($N_1 \leq N_2$) satisfy relationships $F_1=N_1 \cos \theta_1$ and $F_2=N_2 \cos \theta_2$, respectively. For example, letting $\theta_1$ be 60° and $\theta_2$ be 45°, the relationship $F_1<F_2$ is established. That is, as a difference between $\theta_1$ and $\theta_2$ increases, the difference between $F_1$ and $F_2$ increases, and the upstream developing sleeve 8A can transfer the developer to the downstream developing sleeve 8B more easily. Consequently, it is possible to transfer the developer efficiently. As described above, by forming the upstream side of each groove in the downstream developing sleeve 8B to be steeper than that in the upstream developing sleeve 8A, it is possible to secure the excellent transfer performance. Since the magnetic force around the transfer region acts in a direction from the upstream developing sleeve 8A to the downstream developing sleeve 8B due to the magnetic force between the respective magnets of the sleeves, the vertical reactions $N_1$ and $N_2$ basically have a relationship $N_1 \leq N_2$. Thus, the angle between $\theta_1$ and $\theta_2$ specifies the magnitude relationship between $F_1$ and $F_2$, thereby determining the transfer efficiency.

Figure 6B:
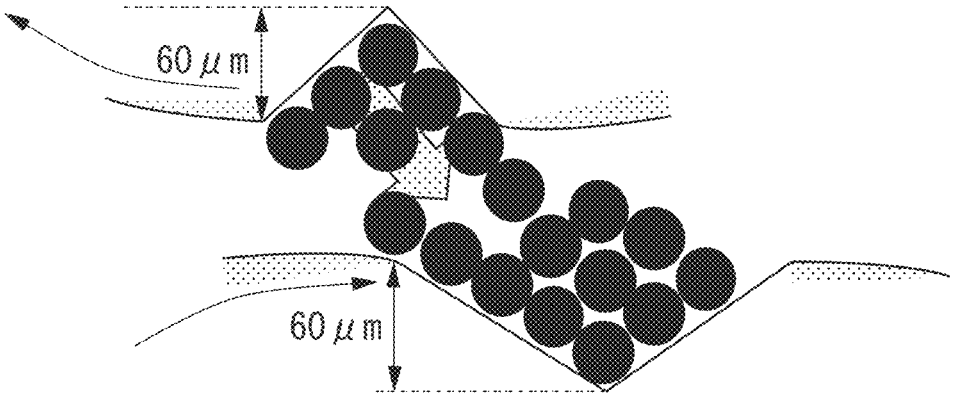
FIG. 6B is a schematic view illustrating transfer of the developer in the comparative example.

As for Comparative Example 1, the angle of each groove in the downstream developing sleeve 8B was made larger than that in the upstream developing sleeve 8A. In this comparative example, the coating amount of the developer on the downstream developing sleeve 8B is below 30 mg/cm$^2$ from the early stage, and becomes equal to or less than the coating amount supplied from the upstream developing sleeve 8A. It appears that the developer corresponding to this difference is not transferred between the sleeves but co-rotates with the upstream developing sleeve 8A. As opposed to Example 1-1, the upstream side of each groove in the downstream developing sleeve 8B is gentler than in the upstream developing sleeve 8A, as illustrated in FIG. 4B. Therefore, it appears that the chipping effect of the downstream developing sleeve 8B is reduced, as illustrated in FIG. 6B. Letting $\theta_1$ be 45° and be 60° in FIG. 4B, $F_2$ of this comparative example becomes smaller than that of Example 1-1, so that the transfer efficiency is degraded in Comparative Example 1.

Since a large number of grooves are not provided in this comparative example, the sleeve contamination of the grooves caused by the degraded developer is at a low level, and the variation in durability caused by the idle rotation is also at a low level.

Next, as for Comparative Example 2, the number of grooves in the downstream developing sleeve 8B was made larger than that in Comparative Example 1 to improve the transfer capacity. In this comparative example, although the coating amount of the developer on the downstream developing sleeve 8B did not greatly differ from that of the upstream developing sleeve 8A in the early stage, the coating amount on the downstream developing sleeve 8B decreased along with the idle rotation. Since a large number of grooves are provided in the downstream developing sleeve 8B, many grooves pass through a pool of the developer which stays between the sleeves. Therefore, it appears that the developer is degraded by being rubbed, thus accelerating the sleeve contamination of each groove.

Next, as for Comparative Example 3, the grooves in the downstream developing sleeve 8B were made deeper than those in Comparative Example 2 to maintain a coating amount constant before and after the idle rotation. In this comparative example, the coating amount of the developer on the downstream developing sleeve 8B is maintained at 30 mg/cm$^2$ or more after the idle rotation, but the coating amount increases in the early stage. It appears that in Comparative Example 3, the deep grooves secure the conveyance capacity even when the sleeve contamination occurs, but the developer which has not been magnetically chipped by the repulsive magnetic pole in the downstream developing sleeve 8B co-rotates with the upstream developing sleeve 8A.

Example 1-2 was also examined. In this example, an angular difference ($\Delta\theta=\theta_1-\theta_2$) between the respective upstream sides of grooves in the upstream developing sleeve 8A and the downstream developing sleeve 8B, which is characteristic of the present exemplary embodiment, was changed. Example 1-2 had an angular difference $\Delta\theta$ of 5°, and yielded a better result than in the comparative examples. Example 1-2, however, exhibited an inferior transfer capacity to Example 1-1 having an angular difference $\Delta\theta$ of 15°. The above result demonstrates that it is necessary to form the upstream side of each groove in the downstream developing sleeve 8B to be steeper than that of the upstream developing sleeve 8A. In addition, it is desirable that the angular difference $\Delta\theta$ between the upstream sides of grooves fall within a range of 10 degrees or more as a more proper range. Table 1 summarizes the above examination results.

Preferred ranges of other groove shapes are as follows. The depth of each groove ranges from 40 μm or more to 80 μm or less, the number of grooves ranges from approximately 40 to 80, and each groove angle ranges from 60° or more to 120° or less. If the grooves are excessively shallow, a developer is not retained in the grooves so that the transfer capacity cannot be secured. The depth of the groove needs to be large enough to cause a carrier to be caught therein. In other words, the depth of the groove needs to be at least larger than the radius of the carrier. Further, the depth of the groove can be larger than the diameter of a carrier. If the grooves are excessively deep, however, the downstream developing sleeve 8B may cause the co-rotation of the carrier. If an excessively small number of grooves are provided, the transfer capacity cannot be secured. If an excessively large number of grooves are provided, on the other hand, the degradation of a developer may be accelerated between the upstream developing sleeve 8A and the downstream developing sleeve 8B. If the grooves having an excessively small groove angle are provided, the volume of the grooves becomes small. If the grooves having an excessively large groove angle are provided, on the other hand, a developer may be removed from the grooves. Neither case can secure conveyance capacity. In this exemplary embodiment, therefore, it is desirable for the angular difference between the respective upstream sides of grooves in both sleeves to range from 10° or more to 30° or less.

This exemplary embodiment has been described regarding a case where the upstream developing sleeve 8A and the downstream developing sleeve 8B have the same number of grooves with the same depth; however, the exemplary embodiment of the present invention is not limited to this groove configuration. The present invention can still be effective, as long as an angle which a normal forms with a side of each groove which is located upstream in a rotational direction satisfies the above-described relationship.

TABLE 1

| | upstream developing sleeve | | | downstream developing sleeve | | |
|---|---|---|---|---|---|---|
| | | | | | quantity | |
| | depth of groove | quantity of grooves | angle of groove | depth of groove | of grooves | angle of groove |
| Example 1-1 | 60 μm | 60 | 120° | 60 μm | 60 | 90° |
| Example 1-2 | 60 μm | 60 | 120° | 60 μm | 60 | 110° |
| Comparative Example 1 | 60 μm | 60 | 90° | 60 μm | 60 | 120° |
| Comparative Example 2 | 60 μm | 60 | 90° | 60 μm | 120 | 90° |
| Comparative Example 3 | 60 μm | 60 | 90° | 90 μm | 120 | 90° |

| | result | | |
|---|---|---|---|
| | transfer capacity | sleeve contamination | co-rotation |
| Example 1-1 | excellent | excellent | excellent |
| Example 1-2 | excellent | excellent | excellent |
| Comparative Example 1 | poor | excellent | excellent |
| Comparative Example 2 | excellent | poor | excellent |
| Comparative Example 3 | excellent | acceptable | poor |

Next, other exemplary embodiments of the present invention will be described. A primary configuration and operation of an image forming apparatus of a second exemplary embodiment are similar to those of the first exemplary embodiment. The same reference characters are accordingly given to constituent elements which have similar or corresponding functions or configurations, and a detailed description thereof will be omitted. Characteristics of this exemplary embodiment will be described below.

Figure 7:
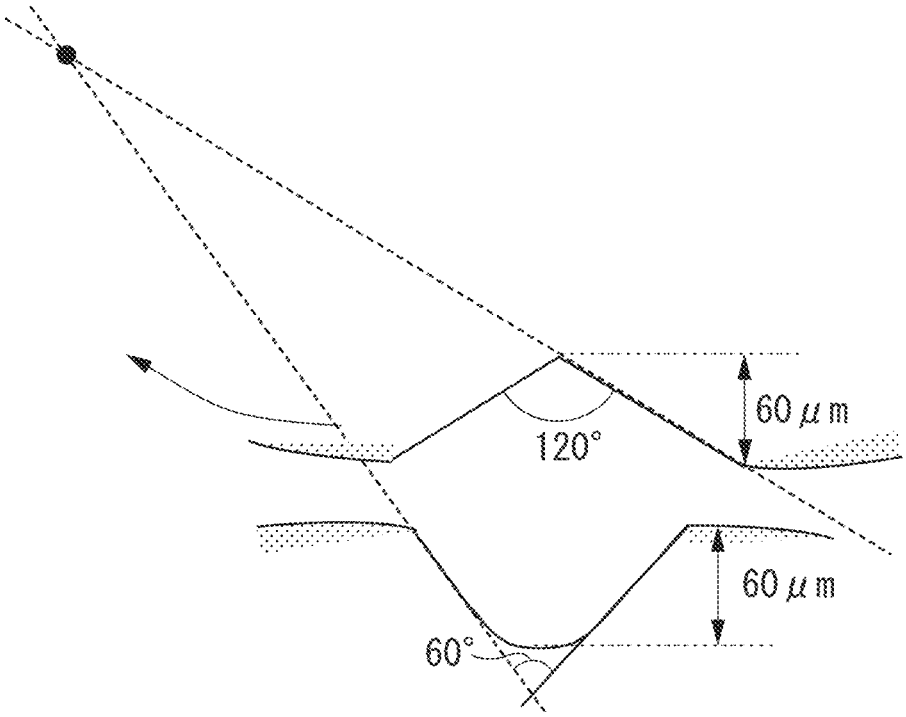
FIG. 7 is a schematic view illustrating a configuration of upstream and downstream developing sleeves which can implement a second exemplary embodiment of the present invention.

In the first exemplary embodiment, each groove in the downstream developing sleeve 8B which is orthogonal to the shaft of the downstream developing sleeve 8B has the V-shape in cross-section. However, the shape of the cross-section of each groove in the downstream developing sleeve 8B need not be limited to the V-shape. In this exemplary embodiment, the downstream developing sleeve 8B may employ a U-shaped or rectangular grooves. The U-shaped groove refers to a groove having a substantially circular bottom and linearly inclined sides. The rectangular groove refers to a groove having a substantially flat bottom that forms approximately 90° with each side. By drawing using a dice, each groove may be actually formed to have a somewhat curved bottom. Even in this case, an angle between the respective extensions of two sides which intersect each other as illustrated in FIG. 7 is referred to as a groove angle.

Figure 8:
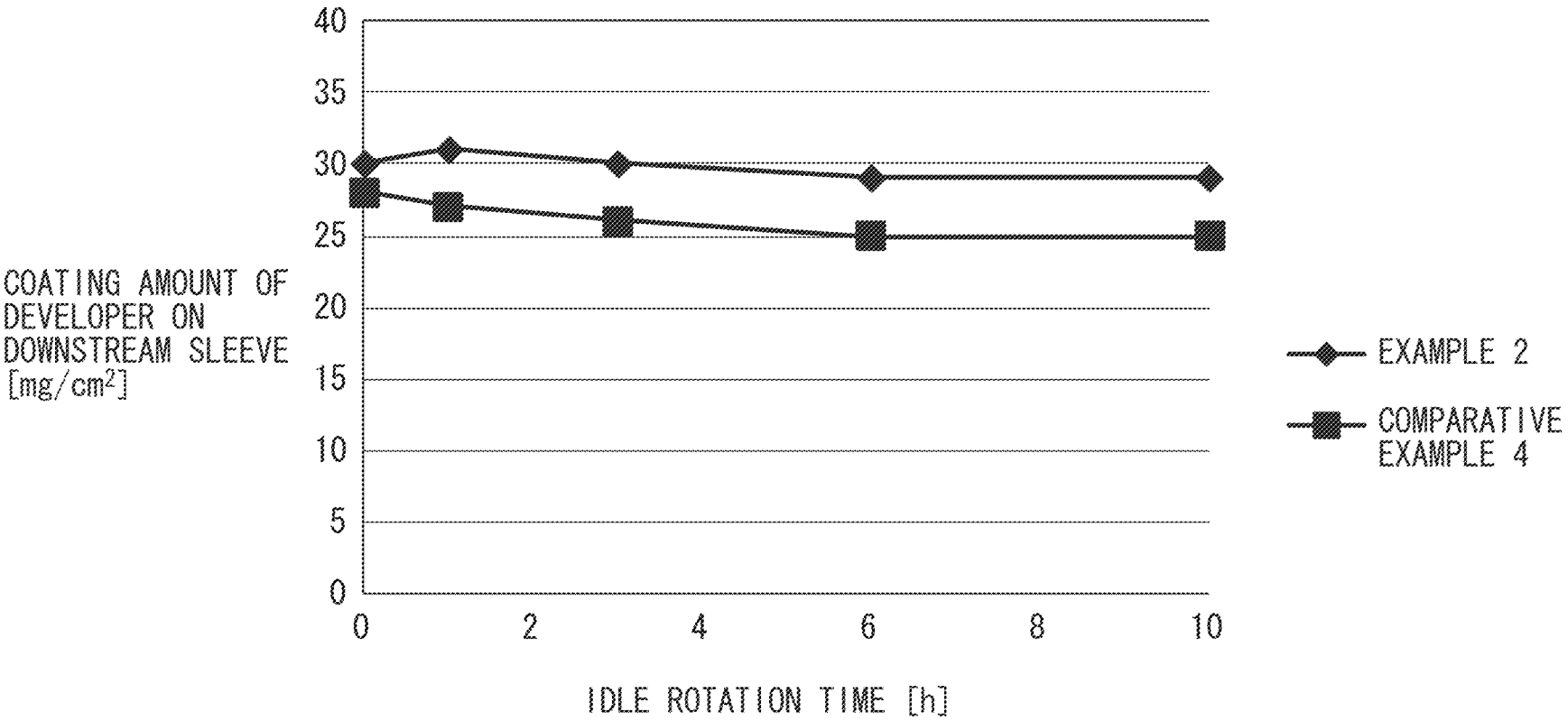
FIG. 8 is a graph illustrating a result of an idle rotation acceleration test conducted in the second exemplary embodiment of the present invention.

The upstream developing sleeve 8A has 60 V-shaped grooves continuously formed at equal distances, and each of these grooves has a depth of 60 μm and a groove angle of 120°. The downstream developing sleeve 8B has 60 U-shaped grooves continuously formed at equal distances, and each of these grooves has a depth of 60 μm and a groove angle of 60°. Employing the U-shaped grooves enables the groove angle of the downstream developing sleeve 8B to be smaller than that in the first exemplary embodiment. As a result, an angular difference between the respective upstream sides of grooves in the upstream developing sleeve 8A and the downstream developing sleeve 8B increases, while the volume of each groove in the downstream developing sleeve 8B does not decrease significantly. An idle rotation acceleration test was conducted on both Example 2 having U-shaped grooves with a groove angle of 60° and a comparative example having V-shaped grooves with a groove angle of 60° in the downstream developing sleeve 8B. FIG. 8 and Table 2 illustrate this result. The coating amount for the U-shaped grooves according to the second exemplary embodiment continuously yields a suitable result from the early stage, whereas the coating amount for the V-shaped grooves is at a low level. Although the V-shaped grooves with a groove angle of 60° show an acceptable coating amount, this result reveals that it is necessary to increase the volume of each groove to some extent. Thus, providing the U-shaped grooves enables a groove upstream angular difference to be increased while the volume of each groove to be secured.

TABLE 2

| | upstream developing sleeve | | | downstream developing sleeve | | |
|---|---|---|---|---|---|---|
| | | | | quantity | | |
| | depth of groove | quantity of grooves | angle of groove | depth of groove | of grooves | angle of groove |
| Example 2 | 60 μm | 60 | V-shape 120° | 60 μm | 60 | U-shape 60° |
| Comparative Example 4 | 60 μm | 60 | V-shape 120° | 60 μm | 60 | V-shape 60° |

TABLE 2-continued

| | result | | |
|---|---|---|---|
| | transfer capacity | sleeve contamination | co-rotation |
| Example 2 | excellent | excellent | excellent |
| Comparative Example 4 | excellent | excellent | excellent |

Next, still another exemplary embodiment of the present invention will be described. A primary configuration and operation of the image forming apparatus of a third exemplary embodiment are similar to those of the first exemplary embodiment. The same reference characters are accordingly given to constituent elements which have similar or corresponding functions or configurations, and a detailed description thereof will be omitted. Characteristics of this exemplary embodiment will be described below.

Figure 9:
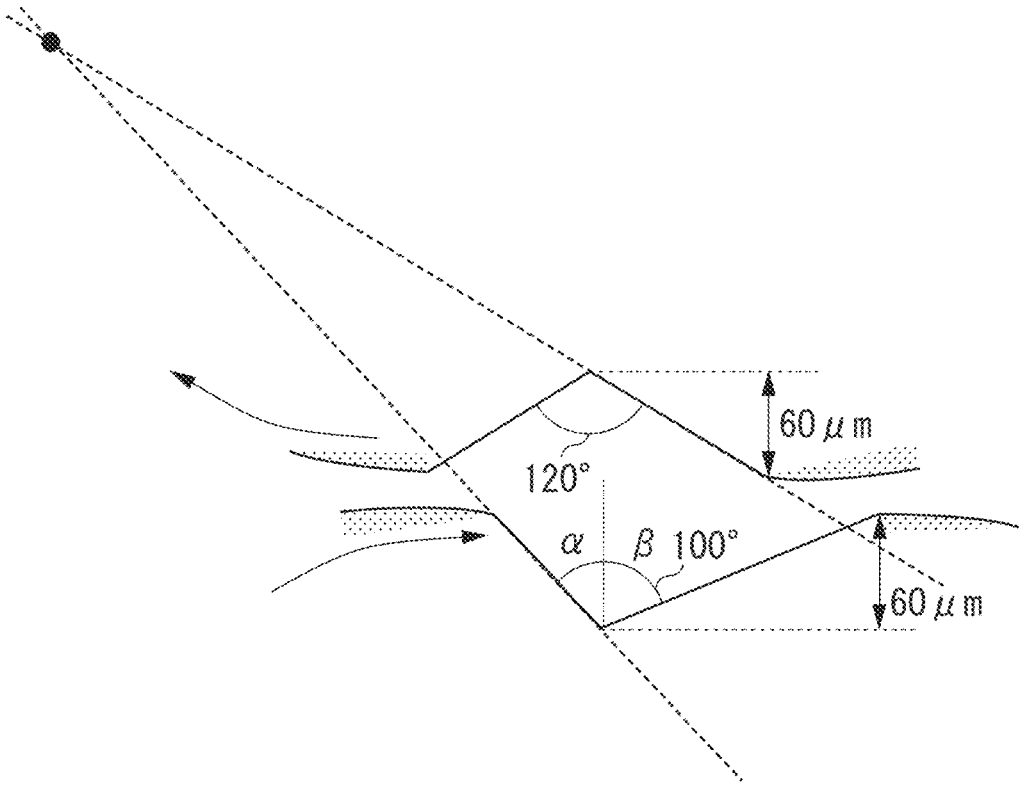
FIG. 9 is a schematic view illustrating a configuration of upstream and downstream developing sleeves that can implement a third exemplary embodiment of the present invention.

This exemplary embodiment employs a groove shape in which the groove upstream angular difference between the upstream developing sleeve 8A and the downstream developing sleeve 8B is set larger than in the first exemplary embodiment and the volume of each groove in the downstream developing sleeve 8B is set slightly larger than that in the first exemplary embodiment, similar to the second exemplary embodiment. As illustrated in FIG. 9, by providing the downstream developing sleeve 8B with asymmetrical grooves, a side of each groove which is located upstream in a rotational direction is made steep and the downstream side of each groove is made gentle. This groove structure can increase the groove upstream angular difference between the upstream developing sleeve 8A and the downstream developing sleeve 8B and slightly increase the volume of each groove in the downstream developing sleeve 8B.

Figure 10:
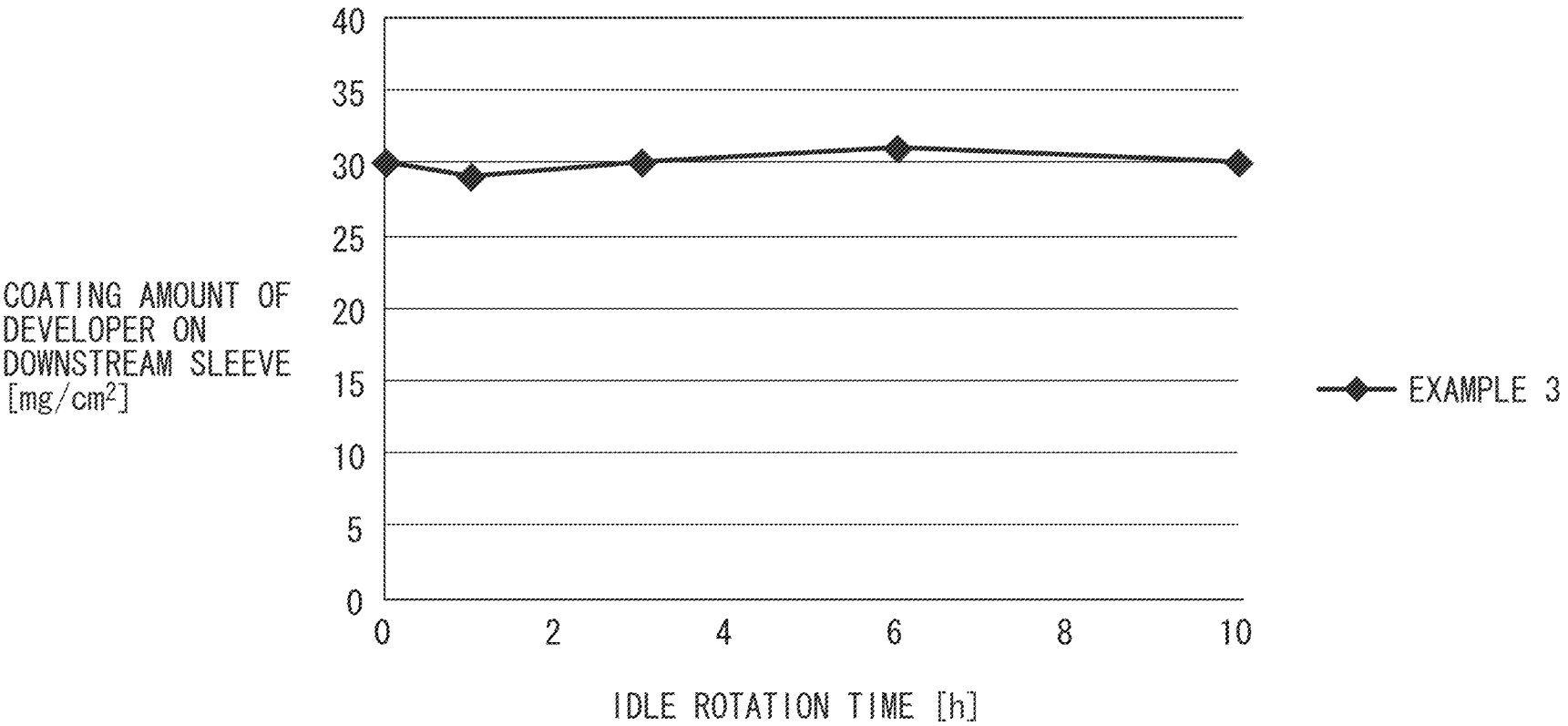
FIG. 10 is a graph illustrating a result of an idle rotation acceleration test conducted in the third exemplary embodiment of the present invention.
Figure 11A:
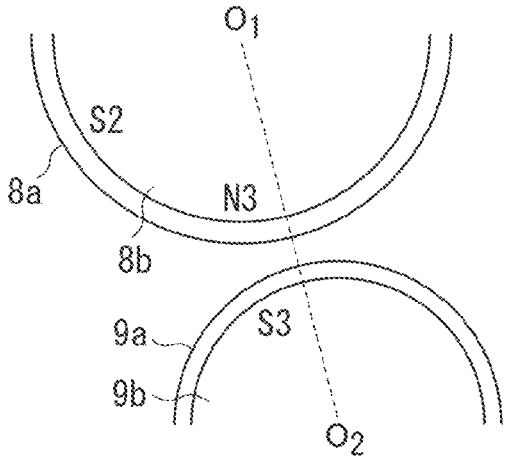
FIGS. 11A, 11B, and 11C are views illustrating a prior art.
Figure 11B:
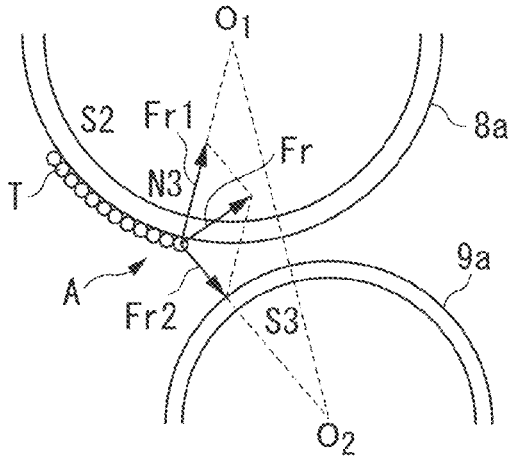
Figure 11C:
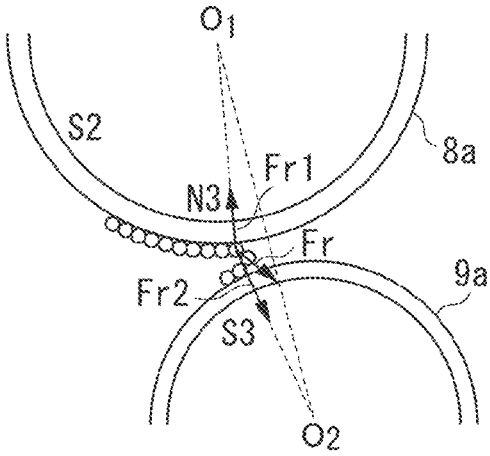
Figure 12A:
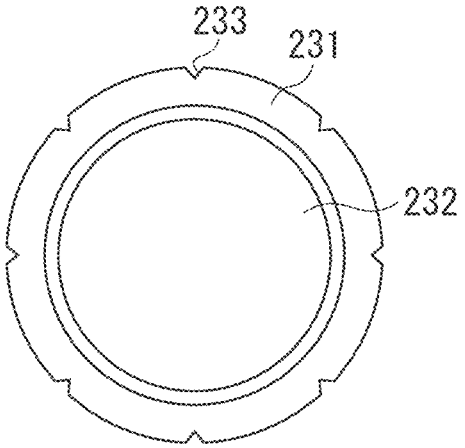
FIGS. 12A and 12B are views illustrating a prior art.
Figure 12B:
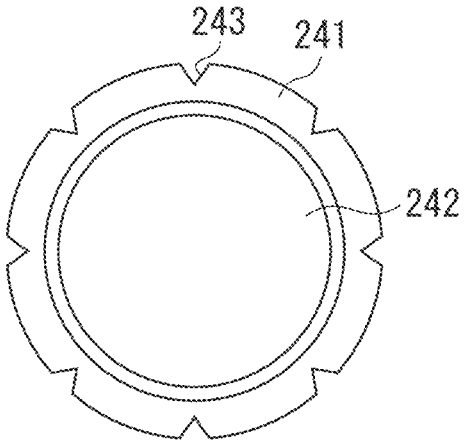

Each groove may have either a V-shape or a U-shape. Assume that an angle which the upstream side of a groove forms with a line extending vertically from the peak of the groove is denoted by $\alpha$, and an angle which the downstream side of the groove forms with the above line is denoted by $\beta$. In this exemplary embodiment, $\alpha$ and $\beta$ are set to 30° and 70°, respectively, in a V-shaped groove. As a result, the groove upstream angular difference becomes 30° that is similar to a case of using symmetrical V-shaped grooves with a groove angle of 60°, but the volume fraction of the grooves becomes 110°. The result of the idle rotation acceleration test in FIG. 10 also demonstrates the excellent progression of the coating amount on the downstream developing sleeve 8B.

The exemplary embodiments of the present invention can provide a developing device that transfers a developer between a plurality of developer bearing members whose surfaces are subjected to groove processing, and that can improve efficiency of transferring the developer between the developer bearing members while suppressing the degradation of the developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-260073 filed Nov. 28, 2012, which is hereby incorporated by reference herein in its entirety.

What is claimed is:

1. A developing device comprising:

a first developer bearing member having a surface provided with a plurality of grooves, the first developer bearing member being configured to bear a developer containing at least magnetic particles on the surface with a magnetic force, and to convey the developer to a first developing region opposite an image bearing member; and a second developer bearing member having a surface provided with a plurality of grooves, the second developer bearing member being configured to rotate in the same rotational direction as the first developer bearing member, to receive the developer from the first developer bearing member at a site opposite the first developer bearing member, and to bear the received developer on the surface with a magnetic force to convey the received developer to a second developing region opposite the image bearing member, wherein an angle θ1 that a surface, which is located upstream in the rotational direction, of each groove in the first developer bearing member forms with a normal to the first developer bearing member is larger than an angle θ2 that a surface, which is located upstream in the rotational direction, of each groove in the second developer bearing member forms with a normal to the second developer bearing member.

2. The developing device according to claim 1, wherein a surface, which is located downstream in the rotational direction, of each groove in the second developer bearing member forms a greater angle with the normal to the second developer bearing member than the surface, which is located upstream in the rotational direction, of each groove in the second developer bearing member.

3. The developing device according to claim 1, wherein each groove has a depth of 40 μm or more to 80 μm or less.

4. The developing device according to claim 1, wherein at least in the second developer bearing member, each groove has a circular bottom and inclined sides.

5. The developing device according to claim 1, wherein at least in the second developer bearing member, each groove has a flat bottom.

6. The developing device according to claim 1, wherein an angular difference θ1−θ2 ranges from 10° or more to 30° or less.

7. The developing device according to claim 1, wherein each groove has a V-shaped cross-section and a bottom inclined at an angle of 60° or more to 120° or less.

* * * * *